US011225367B2

(12) United States Patent
Paetow et al.

(10) Patent No.: US 11,225,367 B2
(45) Date of Patent: Jan. 18, 2022

(54) MULTI-CHAMBER FILM BAG AND USE THEREOF

(71) Applicant: Hilti Aktiengesellschaft, Schaan (LI)

(72) Inventors: Mario Paetow, Landsberg am Lech (DE); Jekaterina Miller, Ostfildern (DE)

(73) Assignee: Hilti Aktiengesellschaft, Schaan (LI)

( * ) Notice: Subject to any disclaimer, the term of this patent is extended or adjusted under 35 U.S.C. 154(b) by 336 days.

(21) Appl. No.: 16/340,750

(22) PCT Filed: Oct. 10, 2017

(86) PCT No.: PCT/EP2017/075749

§ 371 (c)(1),
(2) Date: Apr. 10, 2019

(87) PCT Pub. No.: WO2018/069281

PCT Pub. Date: Apr. 19, 2018

(65) Prior Publication Data

US 2021/0221598 A1 Jul. 22, 2021

(30) Foreign Application Priority Data

Oct. 12, 2016 (EP) ..... 16193443

(51) Int. Cl.
*B65D 81/32* (2006.01)

(52) U.S. Cl.
CPC ..... *B65D 81/3266* (2013.01)

(58) Field of Classification Search
CPC ..... B65D 81/3266
(Continued)

(56) References Cited

U.S. PATENT DOCUMENTS 3,809,224 A * 5/1974 Greenwood ..... B65D 81/3266 206/219
4,402,402 A * 9/1983 Pike ..... B65D 81/3266 206/219

(Continued)

FOREIGN PATENT DOCUMENTS

DE 195 45 120 6/1996
DE 296 20 553 U1 1/1998

(Continued)

OTHER PUBLICATIONS

International Search Report dated Nov. 27, 2017 in PCT/EP2017/075749 with English-language translation (5 pp.).

(Continued)

*Primary Examiner* — J. Gregory Pickett
*Assistant Examiner* — Tia Cox
(74) *Attorney, Agent, or Firm* — Grüneberg and Myers PLLC

(57) ABSTRACT

A multi-chamber film bag for an inorganic multi-component foam system has at least two chambers which are partitioned off from each other in a liquid-tight manner. One of the chambers is filled with an inorganic component in powder form, on the basis of either gypsum or cement mortar, and another chamber is filled with a foaming component in powder form which can react with the component. A partition element separates the chambers from each other in a liquid-tight manner in a first state and can provide a flow connection between the chambers in a second state. At least one of the chambers has an opening section which can be opened to discharge the foam system, wherein the chamber having the opening section has a predefined residual volume for receiving a liquid.

14 Claims, 1 Drawing Sheet

(58) Field of Classification Search
USPC ..... 206/221
See application file for complete search history.

(56) References Cited

U.S. PATENT DOCUMENTS

| | | | | |
|---|---|---|---|---|
| 5,370,221 | A * | 12/1994 | Magnusson | A61B 17/8822 206/219 |
| 5,699,902 | A * | 12/1997 | Sperry | B29C 44/183 206/219 |
| 5,899,325 | A * | 5/1999 | Bertram | B65D 81/3266 206/219 |
| 6,036,004 | A * | 3/2000 | Bowen | A47J 36/28 206/219 |
| 9,931,458 | B1 * | 4/2018 | Di Naro | A61M 5/1411 |
| 2001/0030134 | A1 * | 10/2001 | Goglio | B65D 81/3266 206/221 |
| 2002/0020827 | A1 * | 2/2002 | Munzenberger | C08G 18/4018 252/3 |
| 2002/0086806 | A1 * | 7/2002 | Giblin | B65D 81/3266 510/296 |
| 2005/0033207 | A1 * | 2/2005 | Anders | B29C 44/183 602/8 |
| 2007/0272731 | A1 * | 11/2007 | Visser | E05G 1/14 232/1 D |
| 2010/0290718 | A1 * | 11/2010 | Laubacher | B65D 81/3266 383/38 |
| 2011/0079608 | A1 * | 4/2011 | Mamiye | B65D 75/5822 222/94 |
| 2011/0100844 | A1 * | 5/2011 | Cimaglio | B65D 81/3261 383/38 |
| 2011/0182530 | A1 * | 7/2011 | Park | B65D 81/3261 383/38 |
| 2014/0140166 | A1 * | 5/2014 | Smith | B65D 81/3266 366/348 |
| 2015/0043838 | A1 * | 2/2015 | Jaouen | A45D 34/04 383/38 |
| 2016/0106519 | A1 * | 4/2016 | Hashiguchi | A61C 5/50 206/222 |
| 2017/0073142 | A1 * | 3/2017 | Loomis | C08G 18/42 |
| 2017/0144822 | A1 * | 5/2017 | Murray | B65D 81/3266 |
| 2018/0327168 | A1 * | 11/2018 | Welch | A45D 34/042 |

FOREIGN PATENT DOCUMENTS

| | | |
|---|---|---|
| EP | 0 132 632 | 2/1985 |
| EP | 2 045 227 | 4/2009 |

OTHER PUBLICATIONS

Written Opinion dated Nov. 27, 2017 in PCT/EP2017/075749 (6 pp.).

* cited by examiner

MULTI-CHAMBER FILM BAG AND USE THEREOF

This application is a National Stage entry under § 371 of International Application No. PCT/EP2017/075749, filed on Oct. 10, 2017, and which claims the benefit of EP Application No. 16193443.5, filed on Oct. 12, 2016.

The invention relates to a multi-chamber film bag for an inorganic multi-component foam system and to the use of the multi-chamber film bag for packaging and/or processing of an inorganic multi-component foam system. Furthermore, the invention relates to the use of the multi-chamber film bag in a process for production of a foam-in-place foam, especially an inorganic fire-protection foam.

For rapid sealing of openings, such as fire-protection penetrations in the building sector, for example, a reactive material of two components is mixed in place and introduced into the opening. The reactive material should be stable until it cures, so that it does not flow back out of the opening.

In two-component liquid resins such as polyurethane or epoxy resins, stability is achieved by appropriate adjustment of the viscosity of the material. The reactive components are introduced separately into two-component cartridges and mixed with a static mixer. Static mixers are not suitable for mixtures of powder components and liquids, however, because bridging takes place in the powder component and, because of pressure, prevents mixing in the static mixer.

Compounds consisting of powders and liquids are therefore mechanically mixed with one another in an open vessel by means of stirring rods or other mixing aids. The mixed compound may then be introduced manually into the opening to be filled and/or transformed to the desired shape, or are filled into further application aids, such as kneading presses, for example, and introduced into the opening.

If the powder is to be mixed with the liquid in a closed container, further aids such as balls, for example, are needed in a space partly filled with air. A substantially liquid consistency of the mixture is necessary for emptying the container.

Liquid two-component grouting resins are further known, which are introduced in a two-chamber film bag with clamp-type closure. In this case the grouting resin is mixed manually after removal of the clamp-type closure and is then poured into cable lugs, for example.

Multi-component systems for production of gypsum foams and/or cement foams by mixing in open vessels are known, for example, from EP 2 045 227 A. That document describes a hydraulically binding composition for production of inorganic fire-protection or insulating foam-in-place foams with a pH-neutral or alkaline hydraulic binder and a foaming component as well as a foam stabilizer, wherein the foaming component releases oxygen or carbon dioxide. However, the known inorganic fire-protection systems can be introduced into openings only with difficulty and are frequently usable only as a grouting compound with complex formwork devices.

Simple and inexpensive packaging for rapid mixing of the powdered and liquid components for an inorganic foam based on gypsum or mortar in a closed container is not known. Therefore such inorganic foam systems have not been common on the market heretofore, despite a relatively low material price.

The object underlying the invention is to provide a simple, user-friendly and inexpensive form of use and packaging for rapid mixing of powders and liquids in a closed container, especially for an inorganic foam on the basis of gypsum or mortar for fire-protection purposes. The form of use should permit mixing of the components without complex tools and make it possible to introduce the foam system even into openings that are narrow and/or difficult to access.

This object is solved by a multi-chamber film bag according to claim 1. Subject matter of the invention is further the use of the multi-chamber film bag according to claim 10 for packaging and/or processing of an inorganic multi-component foam system, as well as a process for production of a foam-in place foam from an inorganic multi-component foam system using the inventive multi-chamber film bag having the features of claim 11.

Advantageous and expedient configurations of the inventive process and of the inventive film bag are specified in the associated dependent claims, which may be optionally combined with one another.

The invention provides a multi-chamber film bag for an inorganic multi-component foam system, with at least two chambers separated from one another in liquid-tight manner, wherein one of the chambers is filled with a powdered inorganic component, optionally based on gypsum or cement mortar, and another chamber is filled with a powdered foaming component, which is optionally reactive for the inorganic component, and with a separating element, which in a first condition separates the chambers from one another in liquid-tight manner and in a second condition is able to provide fluidic communication between the chambers, wherein at least one of the chambers has an opening portion, which can be opened to discharge the foam system, and wherein the chamber having the opening cross section has a preadjusted residual volume for receiving a liquid.

The inventive multi-chamber film bag makes it possible to provide a film package with fixed quantities, predetermined by the packaging, of the reactive components for the inorganic foam system existing in powder form. Thus erroneous dosing by the user can be reliably prevented and the mixture is ready for immediate use. It is particularly advantageous that a liquid, usually water, necessary for production of the foam is introduced into the film bag on site only just before use, and thus transport weight and transport volume are saved. Because of the predetermined filling volume, exact dosing of the liquid is possible without measuring instruments. The separating element of the multi-component film bag can be opened simply without tools. Good mixing results can be achieved by simple kneading of the components. No mixing and expelling tools are needed to discharge the foam system. Nevertheless, it is still possible to use the inventive film bag to discharge residual quantities with a known film dispenser for one-component compounds.

The opening portion provided for discharge of the foam system in at least one of the chambers may be constructed as a sharply tapered outlet, for example as a nozzle tip and in this way permit dosing of the foam system into openings that are narrow and difficult to access. Furthermore, after the components have been mixed in the film bag, the foam system can already be present in stable pasty consistency, in order to prevent the compound from flowing out of the openings to be filled.

Furthermore, inexpensive and space-saving film packaging is provided with the invention. During mixing of the optionally reactive components in the film bag, no dust generation is able to develop from the powdered component. Contact of the user with the reactive foam components during mixing is excluded, and so a health hazard due to reactive components is avoided. Finally, cleaning of mixing tools and containers is also not necessary, since mixing of the components takes place inside the film packaging.

Although the invention is described hereinafter on the basis of a two-component foam system, multi-component systems, which contain more than two, optionally reactive components that can be introduced into more than two chambers separated from one another in the film bag by separating elements, are also comprised by the invention and can be implemented with little complexity.

According to a preferred embodiment, the multi-component foam system is a two-component foam system of an inorganic fire-protection foam or insulating foam with at least one hydraulic binder, at least one foaming system and optionally a foam stabilizer. Cements, especially Portland cement, trass, pozzolan, hydraulic lime and gypsum or mixtures thereof may be used as the hydraulic binder. As an example, the foaming system may be formed from an alkali metal or alkaline earth carbonate or bicarbonate as the powder component and a powdered acid as the foaming component. The term powdered acid means a chemical compound that causes an acid reaction when it is dissolved in water, for example citric acid or water-soluble salts of a weak base and a strong acid.

Alternatively or additionally, the foaming system may comprise an oxygen carrier and a catalyst. Powdered peroxides or percarbonates, especially sodium percarbonate, may be used as the oxygen carrier of the foaming component. For catalytic decomposition, percarbonates of suitable powdered compounds are known, for example in the form of metal salts. Preferably, the catalyst may comprise manganese dioxide, $MnO_2$, in powder form.

At least one of the chambers of the inventive multi-chamber foil bag has an opening cross section, which can be opened to fill the chamber with a liquid and then to discharge the foam system. For this purpose, the chamber having the opening portion has a preadjusted residual volume for receiving liquid, so that the inorganic powdered component, the foaming component and the liquid yield a ready-to-use foam after mixing. The determination of the quantities of components and liquid necessary for this purpose are generally known to the person skilled in the art. Preferably, the liquid is water.

Residual volume means the volume of the chamber remaining after one of the components has been filled into the chamber having the opening portion. The preadjustment may take place on the one hand by ensuring that the volume of the chamber remaining after filling of the powder component corresponds exactly to the quantity of liquid needed for production of a ready-to-use foam. However, the preadjustment may also take place by marking provided on the chamber. In this case, the chamber is not completely filled even after filling of the liquid. In both cases, however, the liquid may be dosed accurately without additional measuring instruments. According to a preferred embodiment, the foaming component is present in the chamber having the opening portion.

The separating element may be formed as a peel seam or as a clamping element. The peel seam may be made by heat-sealing or welding of the film walls of the film bag disposed opposite one another in a border region of a chamber, so that this chamber is separated in liquid-tight manner from the adjoining chamber of the film bag. By selection of the film material and/or by suitable film coatings, it is possible to adjust the tear strength of the peel seam such that the peel seam is tom open by pressure on one of the chambers and fluidic communication is established between the chambers.

According to a further embodiment, the separating element may be formed as a clamping seam. The clamping seam may be formed as a kind of lip-closure bag or zipper connection with two clamping slats engaging one in the other. Application of a clamping rail on the film bag from outside is also possible, wherein the film bag is placed with one flat side on the clamping rail provided with a longitudinal slit and then, with a flexible or rod-shaped clamping strip, pressed from the other flat side of the film bag into the longitudinal slit. Thereby the film walls of the film bag disposed opposite one another are pressed together, and liquid-tight separation of the chambers adjoining the clamp-type closure is formed in the film bag.

The clamping rail and/or the clamping strip may be supplied as loose parts. Thereby flexible subdivision of the chambers in the film bag is possible.

According to a further embodiment, the clamping rail and/or the clamping strip may already be fastened on the outer wall of the film bag, for example by adhesive bonding or welding.

Particularly preferably, the separating element may be equipped with compulsory mixing joints, which permit faster and more homogeneous mixing of the inorganic powder component with the foaming component dissolved for use in the liquid. In particular, solid stays may be provided in the region of the separating element, between the films, disposed opposite one another, of the film bag, or weld seams may be provided, which remain intact and do not tear open due to pressure on one of the chambers.

The multi-chamber film bag may be formed as a stand-up bag, as a flat bag or else as a tubular bag. The production of these systems, while maintaining defined volumes of the chambers, especially of the chamber having the opening portion, is known in principle to the person skilled in the art. The bottom region of stand-up bags is usually made with a W-type fold, which expands in the bottom region during filling of the chamber and ensures a secure base for the film bag. Flat bags are usually formed by placing two plastic films one on top of the other and welding the films around the borders. Tubular bags are obtained by injecting the plastic films from round nozzles to form a film tube and welding the ends of the tube on the bottom side or clamping the ends of the tube with a metal or plastic clip. Preferably, the multi-chamber film bag is formed as a flat bag with peripheral weld seam.

According to a further embodiment of the multi-chamber film bag, the opening portion for discharging the foam system is provided with a screw cap welded in the film bag. A screw cap makes it possible to attach commercial cartridge nozzles or nozzle tips, with which the foam system may be discharged from the film bag in a manner appropriate for the desired purpose of use at the point of application.

According to a further embodiment, the opening portion may be formed to discharge the foam system through a nozzle tip or plastic socket, preferably tapering conically or sharply, welded in the film bag. If necessary, the nozzle tip or socket may also be extended by slipping on a further plastic tip. Preferably, the nozzle tip or plastic socket is closed at its free end and, depending on the desired size of nozzle opening, will be cut to size at the point of application or may be broken off at a provided zone of weakness, such as a tear notch or an annular predetermined breaking point. Hereby no scissors or knives are needed. Thus filling of openings in the building is possible rapidly, easily and inexpensively.

Particularly preferably, the opening portion for discharging the foam system is formed by a socket molded in one piece onto the film bag. The socket may be tubular or may taper conically or sharply toward its free end opposite the chamber. Particularly preferably, the socket is provided at its free end with a weak zone, such as a tear seam, for example, to permit tearing of the socket without tools. In this way, even openings that are difficult to access can be filled rapidly, simply and inexpensively with the foam system. Subject matter of the invention is therefore also a use of the multi-chamber film bag for packaging and/or processing of an inorganic multi-component foam system.

By use of the inventive multi-chamber film bag, it is possible to produce a foam-in-place foam from an inorganic multi-component foam system, wherein one of the chambers of the multi-chamber film bag is filled with a powdered inorganic powder component and another chamber with a powdered foaming component, wherein the chambers, in a first storage condition, are separated from one another in liquid-tight manner by a separating element and wherein, in a second ready-to-use condition, fluidic communication between the chambers may be established by opening of the separating element, wherein the opening portion is opened temporarily prior to opening of the separating element and the preadjusted residual volume of the chamber having the opening portion is filled with a liquid. For formation of the foam, fluidic communication between the chambers is established by opening the separating element, and the components and the liquid are mixed. After the components and the water have been mixed, the formed foam is discharged from the opening portion and introduced into an opening to be filled.

The inorganic multi-component foam system is preferably a two-component foam system, and particularly preferably a fire-protection foam. Preferably, mixing of the inorganic powder component with the powdered foaming component and the liquid in the ready-to-use condition takes place by manual kneading of the compound in the temporarily closed film bag.

In order to disperse the inorganic powder component or the foaming component in the solvent, the opening portion may be closed once again prior to opening of the separating element. Allowance for the expansion of the foam formed from the foam system during mixing may be made because not the entire chamber volume is filled with the inorganic powder component or the foaming component. Thus a sufficient compensating volume is available in the film bag until mixing is complete and the opening portion can be opened once again.

By pressure on the end of the film bag opposite the opening portion, the foam formed from the foam system may then be discharged from the opening portion and introduced into the opening to be filled. The use of nozzle tips with a sharply tapering expulsion opening and a predetermined opening cross section permits selective introduction of the foam system even into narrow gaps with poor accessibility. The nozzle tips may be provided with weak zones, so that no scissors or knives are needed to open the expulsion tip. In this way, openings in the building can be filled rapidly, simply and inexpensively with the foam system.

Further features and advantages of the invention will become apparent from the description hereinafter and from the attached drawings, to which reference is made. In the drawings.

Figure 1:
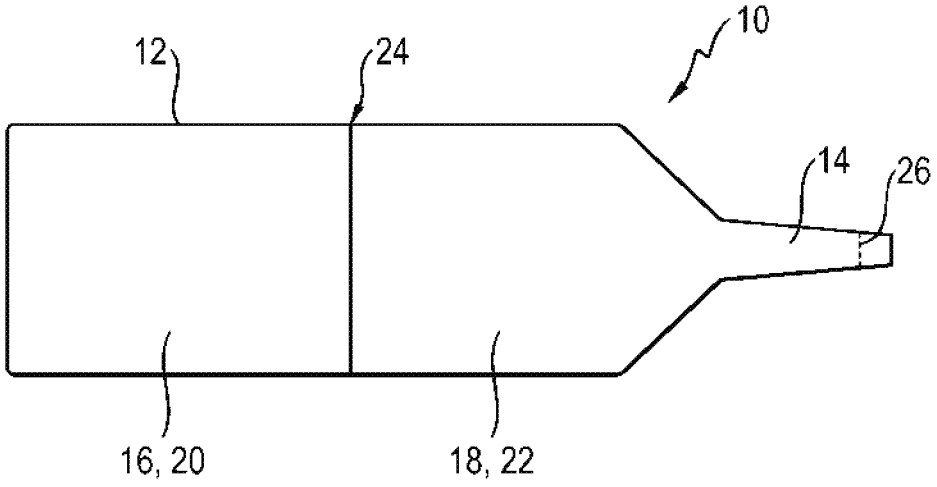
FIG. 1 shows a schematic diagram of the inventive film bag according to a first embodiment.

Multi-chamber film bag 10 illustrated in FIG. 1 is formed as a flat bag with peripheral weld seam 12 and an opening portion 14 in the form of a socket, molded in one piece onto the film bag, for discharging the foam system. Bag 10 has two chambers 16, 18, wherein chamber 16 contains solid inorganic powder component 20 and the other chamber 18 contains a powdered foaming component 22. Chambers 16, 18 are bounded by weld seam 12 around the borders and a separating element 24, illustrated here as a heat-sealed peel seam. The peel seam provides liquid-tight separation of chambers 16, 18 in the storage condition of the film bag. Tear seam 26 formed on socket for simplified opening of the bag is likewise shown. This may be advantageously supplemented or replaced by a notch.

Figure 2:
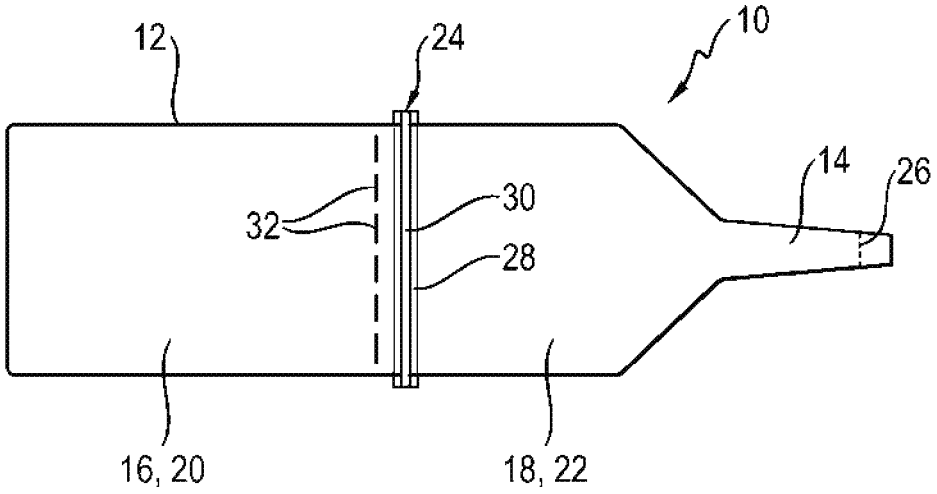
FIG. 2 shows a schematic diagram of the inventive film bag according to a further embodiment.

Multi-chamber film bag 10 illustrated in FIG. 2 is likewise formed as a flat bag with peripheral weld seam 12 and an opening portion 14 in the form of a socket, molded in one piece onto the film bag, for discharging the foam system. Bag 10 has two chambers 16, 18, wherein the one chamber 16 contains solid inorganic powder component 20 and the other chamber 18 contains powdered foaming component 22. Chambers 16, 18 are bounded by weld seam 12 around the borders and a separating element 24, illustrated here as a clamping rail 28 with clamping slat 30. For liquid-tight separation of chambers 16, 18, clamping rail 28 is placed on one flat side of film bag 10 and then clamping strip 30 is pressed from the other flat side of film bag 10 into a longitudinal slit formed in the clamping rail. Thereby the film walls of film bag 10 disposed opposite one another are pressed together in the storage condition.

Compulsory mixing joints 32 in the form of continuous weld seams are further provided in the region of clamping element 24. After opening portion 14 has been opened, chamber 18 has been filled with a liquid, preferably water, through the formed opening, and then clamping element 24 has been opened in the ready-to-use condition of film bag 10, these provide for compulsory mixing of the components in chambers 16, 18. Tear seam 26 formed on socket for simplified opening of the bag is likewise shown. This may be advantageously supplemented or replaced by a notch.

Instead of socket, a nozzle tip welded into the film bag or a screw cap may provided, on which a cartridge nozzle may be attached.

In all embodiments, powder component 20 preferably comprises a hydraulically binding binder based on gypsum or cement mortar, as well as the solid components of the foaming system, such as an alkali metal or alkaline earth carbonate and/or a catalyst for release of oxygen from an oxygen carrier. The foaming component preferably comprises a powdered acid and/or peroxide compound.

As an example, the inorganic powder component for a fire-protection foam may comprise a natural gysum, especially calcium sulfate dihydrate and/or calcium sulfate hemihydrate, pentaerythritol, expandable graphite, calcium carbonate, especially precipitated calcium carbonate, manganese dioxide and glass fibers. The foaming component for the inorganic powder component preferably contains sodium percarbonate. Water is used as the dispersing agent or solvent for the foaming component.

For production of a foam-in-place foam from inorganic multi-component foam system 20, 22, opening portion 14 is opened and chamber 18 preferably containing the foaming component is filled through the formed opening with a liquid, preferably water. The opening portion is then closed once again. This may be done manually, for example, or by using a clamp.

The powder component contained in chamber 18 may be dispersed or dissolved in the liquid. Then separating element 24 is opened and fluidic communication between chambers 16, 18 is established. Film bag 10 then changes from the storage condition, in which chambers 16, 18 are separated from one another in liquid-tight manner, to the ready-to-use condition. By manual kneading, solid inorganic powder component 20 is mixed with dissolved foaming component 22 to form a foam while opening portion 14 is closed.

After mixing, opening portion 14 is opened once again and the foamed compound is discharged from the film bag by pressure on the end of the film bag opposite opening portion 14 and, by means of the socket on opening portion 14, is introduced directly into the opening to be filled in the building. There the compound may be subsequently shaped and cured.

The invention claimed is:

1. A multi-chamber film bag for an inorganic multi-component foam system, the multi-chamber film bag comprising:

at least two chambers separated from one another in liquid-tight manner, wherein one of the chambers is filled with a powdered inorganic component, optionally based on gypsum or cement mortar, wherein another chamber is filled with a powdered foaming component, which is optionally reactive for the powdered inorganic component, and wherein water is not present in the at least two chambers, and a separating element, which in a first condition separates the chambers from one another in liquid-tight manner and in a second condition is able to establish fluidic communication between the chambers, wherein at least one of the chambers has an opening portion, which can be opened to discharge the foam system, and wherein the chamber having the opening cross section has a preadjusted residual volume for receiving a liquid.

2. The multi-chamber film bag according to claim 1, wherein the multi-component foam system is a fire-protection foam.

3. The multi-chamber film bag according to claim 1, wherein the separating element is a peel seam or a clamping element.

4. The multi-chamber film bag according to claim 1, wherein the separating element has a clamping seam or clamping rail with clamping strips.

5. The multi-chamber film bag according to claim 1, wherein compulsory mixing joints are provided in the region of the separating element.

6. The multi-chamber film bag according to claim 1, wherein the film bag is a stand-up bag, a flat bag with edges welded around the borders or a tubular bag.

7. The multi-chamber film bag according to claim 1, wherein the opening portion has a screw cap.

8. The multi-chamber film bag according to claim 1, wherein the opening portion comprises a nozzle tip of plastic welded into the bag.

9. The multi-chamber film bag according to claim 1, wherein the opening portion has a socket with tear seam molded in one piece onto the film bag.

10. A method for packaging and/or processing of an inorganic multi-component foam system, said method comprising:

contacting the multi-chamber film bag according to claim 1 with said inorganic multi-component foam system.

11. A process for production of a foam-in-place foam from an inorganic multi-component foam system using a multi-chamber film bag according to claim 1, said process comprising:

filling one of the chambers of the multi-chamber film bag with a powdered inorganic powder component, optionally based on gypsum or cement mortar, and filling another chamber with a powdered foaming component, which is optionally reactive for the inorganic powder component, wherein none of the chambers of the multi-chamber film bag contain water, wherein the chambers, in a first storage condition, are separated from one another in liquid-tight manner by a separating element, and wherein, in a second ready-to-use condition, fluidic communication between the chambers may be established by opening of the separating element, the opening portion is opened and the preadjusted residual volume of the chamber having the opening portion is filled with a liquid, then, in order to form the foam, fluidic communication between the chambers is established by opening of separating element, and the powdered component and the liquid are mixed, wherein the formed foam is then discharged from the opening portion and introduced into an opening to be filled.

12. The process according to claim 11, wherein the opening portion is closed again prior to opening of the separating element.

13. The process according to claim 11, wherein the mixing of the powder components and the liquid is performed by manual kneading.

14. The multi-chamber film bag according to claim 1, wherein the one of the chambers is filled only with the powdered inorganic component and wherein the another chamber is filled only with the powdered foaming component.

* * * * *